US006666275B2

(12) United States Patent
Neal et al.

(10) Patent No.: US 6,666,275 B2
(45) Date of Patent: Dec. 23, 2003

(54) BRIDGE PLUG

(75) Inventors: Kenneth G. Neal, Duncan, OK (US); Kevin T. Berscheidt, Duncan, OK (US); Don S. Folds, Duncan, OK (US); Ronald L. Hinkie, Marlow, OK (US); Loren C. Swor, Duncan, OK (US); Brian K. Wilkinson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/922,179

(22) Filed: Aug. 2, 2001

(65) Prior Publication Data

US 2003/0024712 A1 Feb. 6, 2003

(51) Int. Cl.[7] ..... E21B 43/12; E21B 23/06

(52) U.S. Cl. ..... 166/386; 166/123; 166/181; 166/387

(58) Field of Search ..... 166/373, 386, 166/387, 123, 181, 129, 183

(56) References Cited

U.S. PATENT DOCUMENTS

| | | | | |
|---|---|---|---|---|
| 2,778,430 | A | 1/1957 | Baker | 166/139 |
| 2,806,536 | A | 9/1957 | Baker et al. | 166/123 |
| 3,289,766 | A | 12/1966 | Bigelow | 166/139 |
| 3,710,862 | A | 1/1973 | Young et al. | 166/278 |
| RE28,641 | E | 12/1975 | Chenoweth | 166/120 |

(List continued on next page.)

FOREIGN PATENT DOCUMENTS

| | | | |
|---|---|---|---|
| GB | 2 126 631 A | 3/1994 | E21B/33/134 |
| GB | 2 348 903 A | 10/2000 | E21B/33/1295 |

OTHER PUBLICATIONS

Smith Services Completion Systems brochure entitled "The Typhoon Packer" dated Nov. 1, 2001.

*Primary Examiner*—David Bagnell
*Assistant Examiner*—Jennifer R. Dougherty
(74) *Attorney, Agent, or Firm*—John W. Wustenburg; John F. Booth

(57) ABSTRACT

A retrievable bridge plug assembly having an internal "pump through" bypass passage and a wedge assembly, slips and seals disposed thereon. A retrieving tool is provided for running, setting, releasing and retrieving the bridge plug assembly. A tubing sensor is included to prevent setting of the bridge plug assembly in improper size tubing. When the bridge plug is properly located, the wedge assembly can actuated by manipulation of the retrieving tool to force the slips radially outward into gripping engagement with the well tubular and to force the seals into sealing engagement with the well tubular. A ball valve on the bridge plug assembly is movable to selectively open and close the bypass passage. The retrieving tool can maintain the valve and passageway open to facilitate circulation during run in and setting and also open during retrieving for pressure equalization. A service packer can be connected to and run with the bridge plug assembly.

24 Claims, 10 Drawing Sheets

U.S. PATENT DOCUMENTS

| | | | | | |
|---|---|---|---|---|---|
| 4,149,594 | A | | 4/1979 | Evans | 166/134 |
| 4,151,875 | A | | 5/1979 | Sullaway | 166/126 |
| 4,185,689 | A | | 1/1980 | Harris | 166/133 |
| 4,230,185 | A | | 10/1980 | Fredd | 166/332 |
| 4,254,983 | A | | 3/1981 | Harris | 294/86.21 |
| 4,427,063 | A | | 1/1984 | Skinner | 166/134 |
| 4,436,150 | A | | 3/1984 | Barker | 166/131 |
| 4,460,041 | A | * | 7/1984 | Berryman | 166/134 |
| 4,545,431 | A | | 10/1985 | Fore | 166/183 |
| 4,567,944 | A | | 2/1986 | Zunkel et al. | 166/120 |
| 4,569,396 | A | | 2/1986 | Brisco | 166/305.1 |
| 4,627,491 | A | | 12/1986 | Zunkel | 166/126 |
| 4,646,829 | A | | 3/1987 | Barrington et al. | 166/125 |
| 4,648,446 | A | | 3/1987 | Fore et al. | 166/123 |
| 4,664,188 | A | | 5/1987 | Zunkel et al. | 166/134 |
| 4,671,356 | A | | 6/1987 | Barker et al. | 166/285 |
| 4,693,309 | A | | 9/1987 | Caskey | 166/123 |
| 4,784,226 | A | | 11/1988 | Wyatt | 166/376 |
| 4,791,988 | A | | 12/1988 | Trevillion | 166/285 |
| 4,834,184 | A | | 5/1989 | Streich et al. | 166/376 |
| 4,898,239 | A | | 2/1990 | Rosenthal | 166/133 |
| 4,928,762 | A | | 5/1990 | Mamke | 166/192 |
| 4,953,617 | A | | 9/1990 | Ross et al. | 166/187 |
| 5,029,643 | A | | 7/1991 | Winslow et al. | 166/131 |
| 5,058,684 | A | | 10/1991 | Winslow et al. | 166/386 |
| 5,086,839 | A | | 2/1992 | Setterberg, Jr. et al. | 166/138 |
| 5,131,468 | A | | 7/1992 | Lane et al. | 166/120 |
| 5,143,015 | A | | 9/1992 | Lubitz et al. | 166/187 |
| 5,224,540 | A | | 7/1993 | Streich et al. | 166/118 |
| 5,271,468 | A | | 12/1993 | Streich et al. | 166/387 |
| 5,390,737 | A | | 2/1995 | Jacobi et al. | 166/184 |
| 5,727,632 | A | | 3/1998 | Richards | 166/387 |
| 6,220,349 | B1 | | 4/2001 | Vargus et al. | 166/138 |
| 6,244,642 | B1 | | 6/2001 | Serafin et al. | 294/86.17 |

* cited by examiner

BRIDGE PLUG

TECHNICAL FIELD

The present invention relates to retrievable bridge plugs and related setting and retrieving tools and in particular to retrievable bridge plugs for placement in pressurized hydrocarbon wells to temporarily seal a portion of the well. The bridge plug has a selectively opened and closed through bore that allows pressure equalization before retrieval and permits well service tools to pass there through without requiring removal of the bridge plug. Improper setting of the bridge plug is prevented by a setting mechanism that is locked until located in the proper size tubing.

DESCRIPTION OF RELATED ART

Bridge plugs are tools that are typically lowered into a cased oil or gas well. When set in position inside the casing, a bridge plug provides a seal to isolate pressure between two zones in the well. Retrievable bridge plugs are used during drilling and workover operations to provide a temporary separation of zones. When multilateral or multibore wells are drilled, bridge plugs are used to temporarily seal off the tubing set in the completed bores or laterals during servicing or completion of additional bores.

Typical bridge plugs are shown in U.S. Pat. No. 4,436,150 issued to Barker on Mar. 13, 1984; U.S. Pat. No. 4,898,239 issued to Rosenthal on Feb. 6, 1990; U.S. Pat. No. 5,058,684 issued to Winslow on Oct. 22, 1997; U.S. Pat. No. 5,727,632 issued to Richards on Mar. 17, 1998; U.S. Pat. No. 6,244,642 issued to Serafin et al. on Jun. 12, 2001. Baker sells a model "GT" LOK-SET Retrievable Bridge Plug and Model "LTC" Retrieving Head. Retrievable bridge plugs typically have anchor elements (slips or the like) and sealing elements. The anchor elements are used to grip the inside surface of a tubular member such as a well casing to prevent the set bridge plug from moving up or down. Note that as used herein, "down", "downward", or "downhole" refer to the direction from the wellhead toward the producing zone regardless of whether the wellbore proceeds straight and directly downward from the surface. Up, upward, and uphole is in the reverse direction of downhole. "Surface" refers either to the ground level or to the ocean floor, as applicable. The sealing elements engage the inside surface of the well casing to provide the requisite seal for the annulus defined between the bridge plug and the casing. Typically, the bridge plug is set in position by radially extending the anchor and the sealing elements to engage the well casing. To retrieve the bridge plug from the well casing, a retrieving tool is lowered down the casing to engage a retrieving latch, which, through a retrieving mechanism, retracts the anchor and the sealing elements, allowing the bridge plug to be pulled out of the well bore.

During well operations, a pressure differential across the plug often develops. It is desirable to equalize this pressure differential before the anchor and sealing elements are disengaged. Equalization prevents the loss of control over the bridge plug, wherein the tool may be blown up or down a well casing in response to the pressure differential. As exemplified by the prior art bridge plugs listed above, such equalization is typically effected through the opening of a bypass passage through the interior of the plug, prior to disengagement of the anchor and sealing elements.

However, a problem is encountered with these prior art devices in their inability to permit testing of well conditions in the completed bore. In these devices testing requires removal of the bridge plug.

With prior art retrievable bridge plugs dangerous situations can occur when setting is attempted in the incorrect location. The anchors and expandable seals of bridge plugs are designed to set in a narrow range of tubing sizes. When retrievable bridge plugs are to be set in tubing located in a lateral, it is essential that the bridge plug be located within the smaller lateral tubing liner before setting. Attempted setting short of the liner damages the tool and results in a defective seal off.

Bridge plugs having seals positioned between anchors causes the compressed seal elements to act as a compression spring. This spring force bears on the slip bodies pushing the carbide buttons on the slips deeper into the tubing. Releasing the slips requires pulling with enough force to actually rip the slip button out of the tubing wall. Typically, steeper slip angles and fewer buttons and slips are used to reduce the amount of force required to pull one set of slips loose. These solutions reduce the holding effectiveness of the slips.

When running the bridge plugs of the prior art in to the well, circulating ports in the inner mandrel are present to allow sufficient fluid bypass flow rates. These circulation ports weaken the inner mandrel and force flow into the interior of the mandrel.

SUMMARY OF THE INVENTION

According to the present invention, an improved retrievable bridge plug assembly and retrieving tool is provided. According to the bridge plug assembly of the present invention, an unobstructed straight central passageway extends through the plug and can be selectively opened and closed by the retrieving tool. When closed, the area below the bridge plug is isolated from the well above the plug. When open, pressure can be applied below the bridge plug and the pressure integrity below the bridge plug can be tested. In addition, this central passageway allows tool access to the area below the bridge plug assembly. For example, both "pump through" and "wire line" tools can pass through the straight central opening. The packer assembly of the present invention utilizes a liner sensor above the slips and seals that prevents the bridge plug for trying to set until the sensor is inside the proper size tubing, preventing attempted setting outside the liner. According to the bridge plug of the present invention, the slips that resist movement are located below the seal elements. This protects the slips from debris and makes the slips easier to retrieve. The improved bridge plug of the present invention utilizes a flow path around the seal slip elements through a concentric bypass between the inner mandrel and the seal/ratchet/slips mandrel. Fluid enters through slots in the lower slip body, passes through slots in the seal/ratchet/slips mandrel and exits through holes in the bypass seal body. The concentric bypass eliminates the need for circulation ports and forces fluid to circulate around the bottom of the bridge plug and through any tail pipe attached to the bottom of the bridge plug.

BRIEF DESCRIPTION OF THE DRAWINGS

The invention will be better understood and its numerous objects and advantages will become more apparent to those skilled in the art by reference to the following drawings, in conjunction with the accompanying specification, in which:

FIGS. 3A–I are detailed partial longitudinal cross-section drawings of a the retrieving head connected to the bridge plug assembly in accordance with the present invention;

DETAILED DESCRIPTION OF A PREFERRED EMBODIMENT

Figure 1:
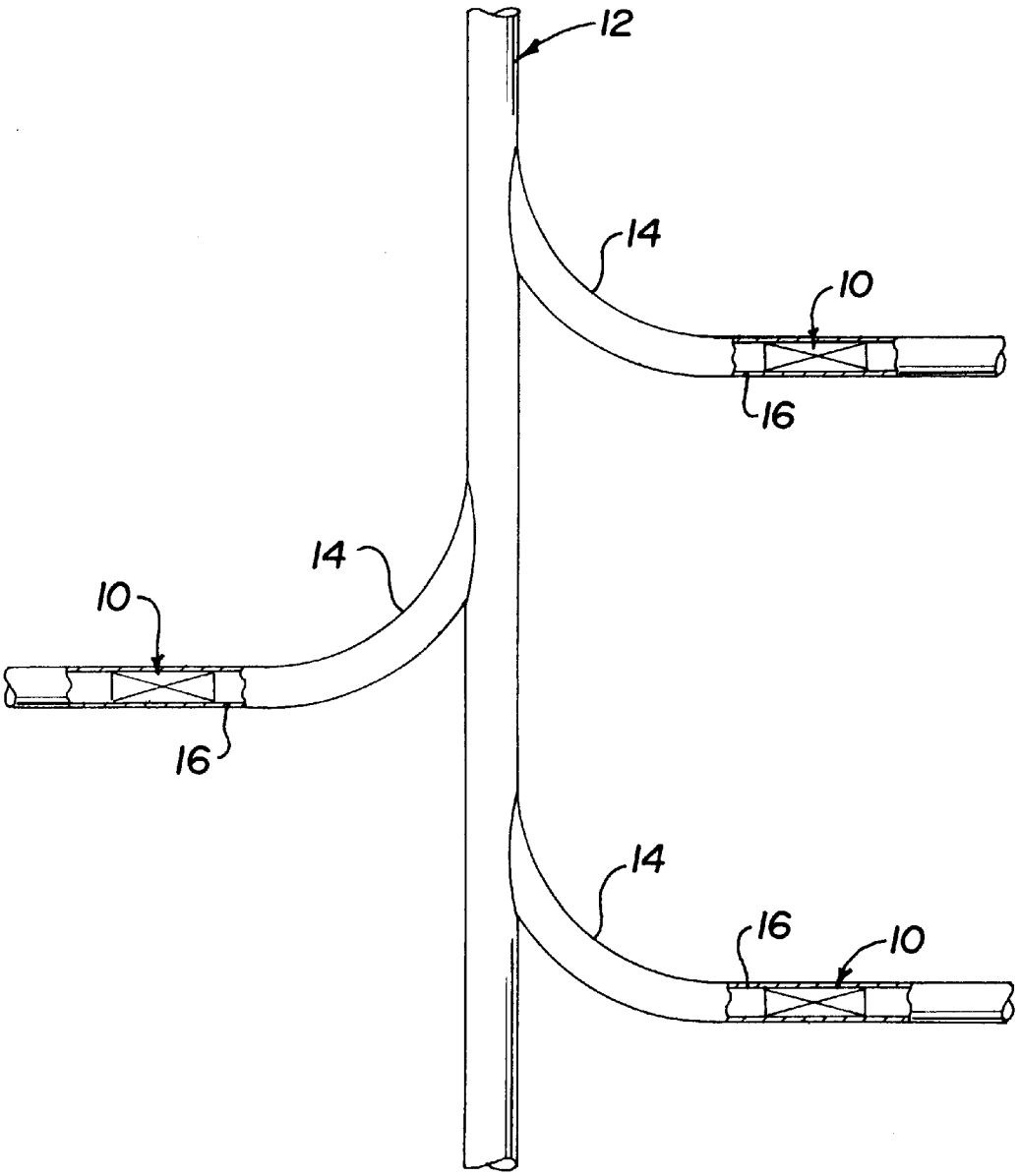
FIG. 1 is a diagram of a multibore hydrocarbon well illustrating the one application for using bridge plug assemblies according to the present invention.

Referring now to the drawings where like or corresponding reference characters are utilized through out the several views to refer to like or corresponding parts there is illustrated in FIG. 1 a simplified longitudinal schematic drawing of a multilateral well showing the location of various retrievable bridge plug assemblies of the present invention. The retrievable bridge plug assembly according to a preferred embodiment of the present invention is generally designated by reference numeral 10 for purposes of description. The well 12 is illustrated as having three separated lateral bores 14 each having a tubular liner 16 set therein. Each of the bridge plug assemblies 10 are shown set in the lateral liner 16 isolating the lateral bores 14 from the well 12.

Figure 2:
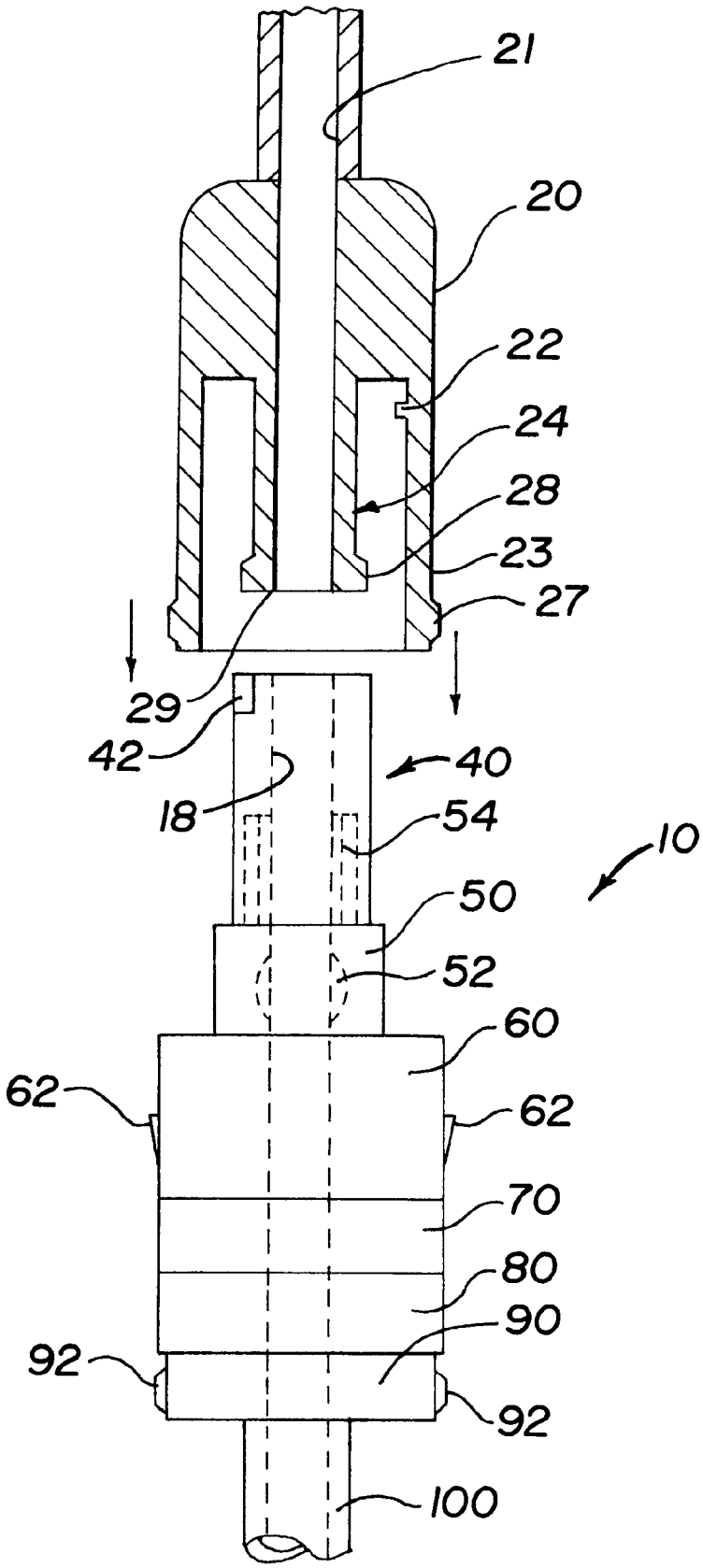
FIG. 2 is a schematic drawing partially in section of the a retrieving head and bridge plug assembly in accordance with the present invention connected by a section of tubing to a packer.

In FIG. 2 a schematic diagram of the bridge plug assembly 10 of the present invention is illustrated along with a retrieving tool 20. The bridge plug assembly 10 comprises a retrieving neck subassembly 40, a valve and actuator subassembly 50, liner sensor subassembly 60, expandable seal or packer subassembly 70, a slip or anchor subassembly 80, a slip and seal setting subassembly 90 and a tail pipe 100.

According to the present invention, bridge plug assembly 10 has a straight passageway or bore 18 extending axially through the entire bridge plug assembly 10 and its sub assemblies. Passageway 18 is connected to communicate with tail pipe 100 and provides tool and testing access to lateral bore 14 without necessitating removal of the bridge plug assembly 10 itself. Retrieving tool 20 also has a central passageway 21. Retrieving tool 20 has pins or lugs 22 which engage a "J-slot" 42 on retrieving neck subassembly 40 to connect the retrieving tool 20 to the bridge plug assembly 10 for installation, servicing and removal. When the retrieving tool 20 is connected to bridge plug assembly 10, passageways 18 and 21 are in sealed fluid communication.

A ball valve 52 in valve and actuator subassembly 50 is selectively operable to fully open and seal off passageway 18. The valve 52 is a two-position valve and is opened when stinger portion 24 of retrieving tool 20 engages a collet assembly 54 in valve and actuator subassembly 50 when the retrieving tool 20 is connected to bridge plug assembly 10. When the retrieving tool 20 is disconnected, valve 52 returns to the closed position.

The liner sensor subassembly 60 comprises spring-loaded fingers 62 that normally locks the slip and seal setting subassembly 90 to prevent it from setting. When the fingers 62 contact the end of tubular liner 16 they deflect to the unlocked position allowing setting of the bridge plug assembly 10. By axially spacing the fingers 62 from the slips and seals, proper location of the bridge plug assembly 10 in the tubing tubular liner 16 is assured before setting.

Slip and seal setting subassembly 90 is utilized to set the bridge plug assembly 10. Setting is accomplished by a series of twists, pulls and pushes applied by the retrieving tool 20 on the retrieving neck subassembly 40. The actuator comprises a cooperating "J-slot" and pin arrangement with a ratchet to progressively expand the seal 70 and slip 80 subassemblies. Spring-loaded drag blocks 92 engage the inside wall of the tubing tubular liner 16 to assist in setting.

Once the bridge plug assembly 10 is set in the tubular liner 16, retrieving tool 20 is separated and removed, and valve 52 closes. To reconnect and open the valve 52, the retrieving tool 20 returned to engage retrieving neck subassembly 40. To remove the bridge plug assembly 10, the retrieving tool 20 is engaged with the retrieving neck subassembly 40 and twisted in the opposite direction from the setting procedure.

The details of the structure and operation of one particular embodiment of the bridge plug assembly 10 of the present invention will be described by reference to FIGS. 3–8. The illustrated embodiment is only one example of practicing the present inventions.

In FIGS. 3A–I the bridge plug assembly 10 is illustrated engaged by the retrieving tool 20. Retrieving tool 20 has an outer sleeve or overshot portion 23 supporting at least one or in this embodiment three internal pins 22 for engaging the "J-slot" 42 on retrieving neck subassembly 40. Overshot portion 23 terminates at an auger portion 27 for removing accumulated materials. The cylindrical stinger portion 24 defines axially extending passageway or internal bore 21. Bore 21 is threaded at 25 for connection to tubing extending to the well surface.

Slot sleeve 41 forms the upper end of retrieving neck subassembly 40. As will be described, slot sleeve 41 is threaded on to outer circulating port sleeve 41*a*, which is in turn threaded on to outer ball valve case 41*b*. An adapter 41*c* provides a threaded connection between the outer ball valve case 41*b* and bridge plug mandrel 71.

Figure 4:
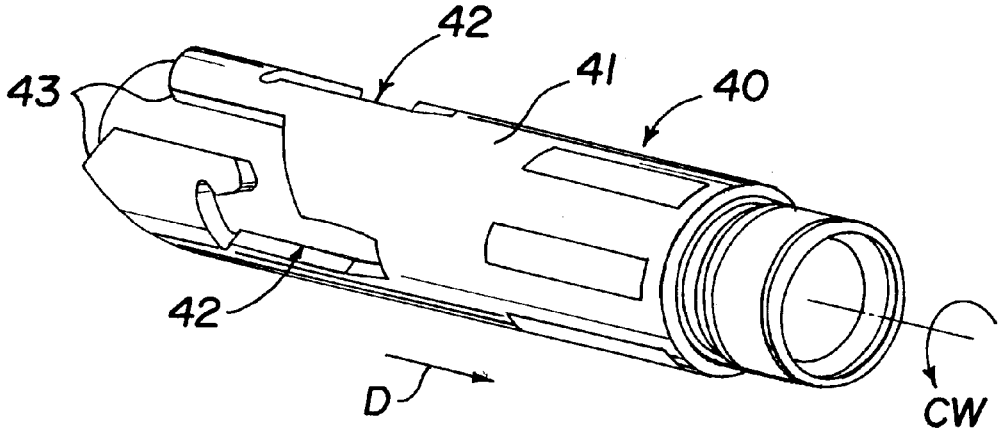
FIG. 4 is a perspective view of an upper J-slot tube in the bridge plug assembly in accordance with the present invention.
Figure 5:
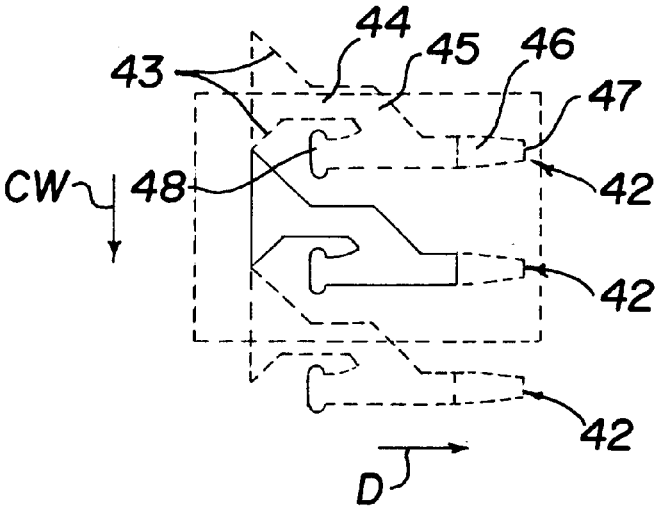
FIG. 5 is a diagram of the j slot pattern in the upper J-slot tube.
Figure 7:
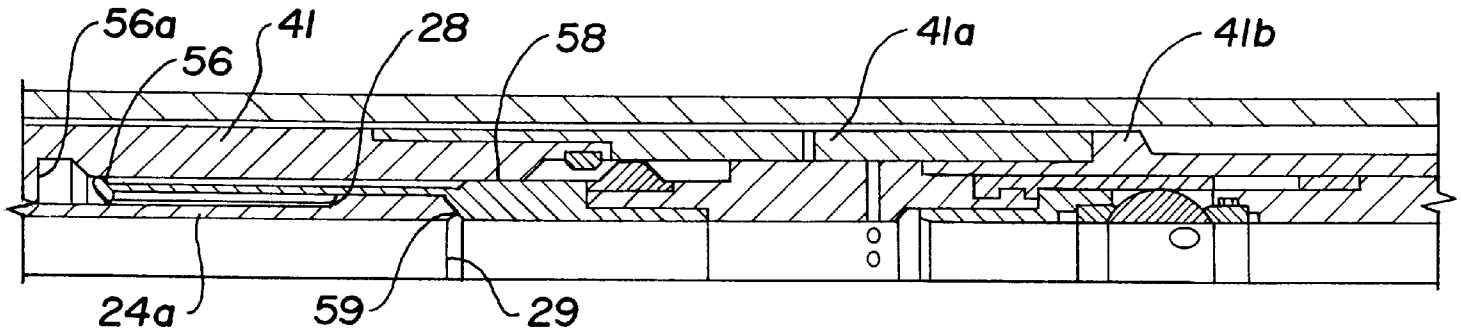
FIG. 7 is a detailed partial longitudinal cross-section drawing of the bridge plug assembly of FIG. 3 illustrated in the run position in accordance with the present invention.
Figure 8:
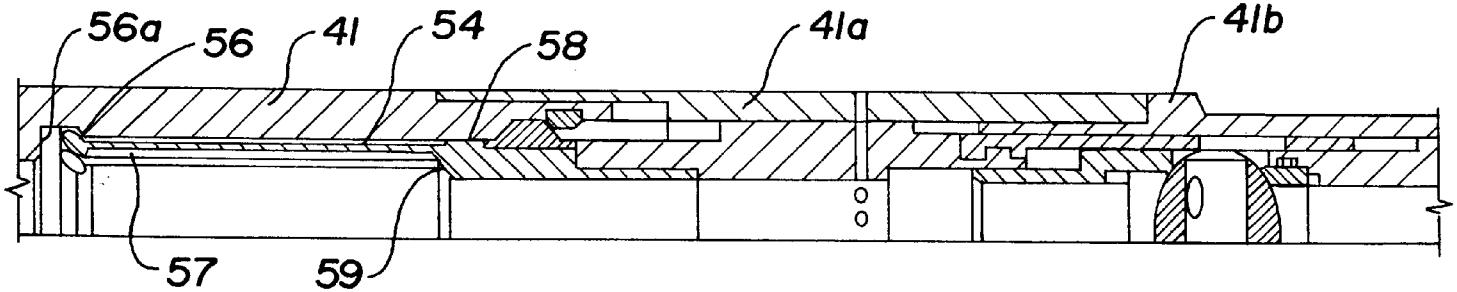
FIG. 8 is a detailed partial longitudinal cross-section drawing of the bridge plug assembly of FIG. 3 illustrated in the set position in accordance with the present invention.

As illustrated in FIGS. 4 and 5 the upward facing ends 43 of "J-slot" 42 form guide surfaces to align pins 22 with first axially extending portion 44. Inclined guide surfaces 45 connect a second axially extending portion 46 to portion 44. When the pins 22 in retrieving tool 20 engage the upward facing ends 43, pins 22 are guided into alignment with portions 44. Further downward movement (in the direction of arrow D) will cause the pins 22 to be guided in a relative clockwise direction (right hand turning of the tool in the direction of arrow cw) into portions 46 and will stop short of shoulder 47. Lifting the retrieving tool 20 without applying counter clockwise torque (left hand turning of the tool) will cause the pins 22 to stop at shoulder 48. As long as pins 22 remain in portion 46, weight (downward force) and tension (upward force) can be applied to the bridge plug assembly 10. To remove the pins 22 from the "J-slot" 42 a counter clockwise torque is applied to the retrieving tool 20 while lifting.

FIG. 4 illustrates a perspective of the slot sleeve 41 of the retrieving neck subassembly 40 and FIG. 5 illustrates a laid out or flat configuration of the "J-slot" 42 for receiving pin or lug 22. A stinger extension 24*a* is threaded at one of its ends to the retrieving tool 20. An external annular shoulder 28 is formed adjacent the other end 29 of the stinger extension 24*a*. When the stinger portion 24 is inserted in or removed from the bridge plug assembly 10, it engages collet 54 in valve and actuator subassembly 50 and moves the valve 52 between the open and closed positions. When the stinger portion 24 is inserted, its end 29 engages internal shoulder 59 on the annular collet body 58 to move the valve 52 to the open position (See FIG. 7). When the stinger portion 24 is removed from the bridge plug assembly 10, shoulder 28 engages the collet 54 and pulls the collet 54 and the valve 52 to the closed position.

The collet 54 (illustrated in FIGS. 3A & B) has a plurality of axially extending collet fingers 55 each terminating with an enlarged head 56. Internal shoulders 57 on each of the heads 56 will engage the shoulder 28 on stinger portion 24 upon removal of the retrieving tool 20 to move the collet 54 and valve 52 to the closed position (See FIG 8). Note in FIG. 8 that when in the closed position the heads 56 are axially aligned with an annular relief grove 56*a* formed in slot sleeve 41. This groove 51*a* allows the heads 56 to deflect radially outward to release the engagement of shoulders 28 and 57 during removal of the retrieving tool 20 from the bridge plug assembly 10.

The collet 54 is connected to operate the valve 52 through a series of sleeves including a lower releasing sleeve holder 54*a*. The valve 52 and its moving seat holder are of the type described in U.S. Pat. No. 4,633,952 to Ringgenberg issued Jan. 6, 1987, which patent is incorporated herein by reference for all purposes. In this valve, a pin engages the ball valve movable in a suitable valve seat, and relative movement between the pin and the seat causes the ball valve to rotate to open and to close.

According to the present invention, the valve and actuator subassembly 50 has the capacity to hold the valve 52 in either the open or closed positions. A releasing sleeve 54*b* is supported in an external annular groove defined between collet 54 and releasing sleeve holder 54*a*. Releasing sleeve 54*b* has upward and downward facing tapered annular shoulders 54*c*. A ring spring 54*d* is contained in an internal annular groove 54*e* defined between slot sleeve 41 and circulating port sleeve 41*a*. Groove 54*e* is slightly axially longer and slightly radially larger than the ring spring 54*d* allowing the ring spring 54*d* to deflect radially outward. Ring spring 54*d* has upward and downward facing tapered annular shoulders 54*f*. As retrieving tool 20 is forced into the bridge plug assembly 10, the downward facing tapered shoulder 54*c* on releasing sleeve 54*b* engages upward facing shoulder 54*f* on ring spring 54*d* and deflects the ring spring 54*d* radially outward into groove 54*e* allowing the releasing sleeve 54*b* to pass through ring spring 54*d*. As the releasing sleeve 54*b* clears ring spring 54*d*, ring spring 54*d* snaps back to its original position. The ring spring 54*d* then holds the retrieving tool 20 in position with the valve 52 deflected to the open position. To remove the retrieving tool 20 the process of deflecting the ring spring 54*d* is repeated in the opposite direction.

Figure 3A:
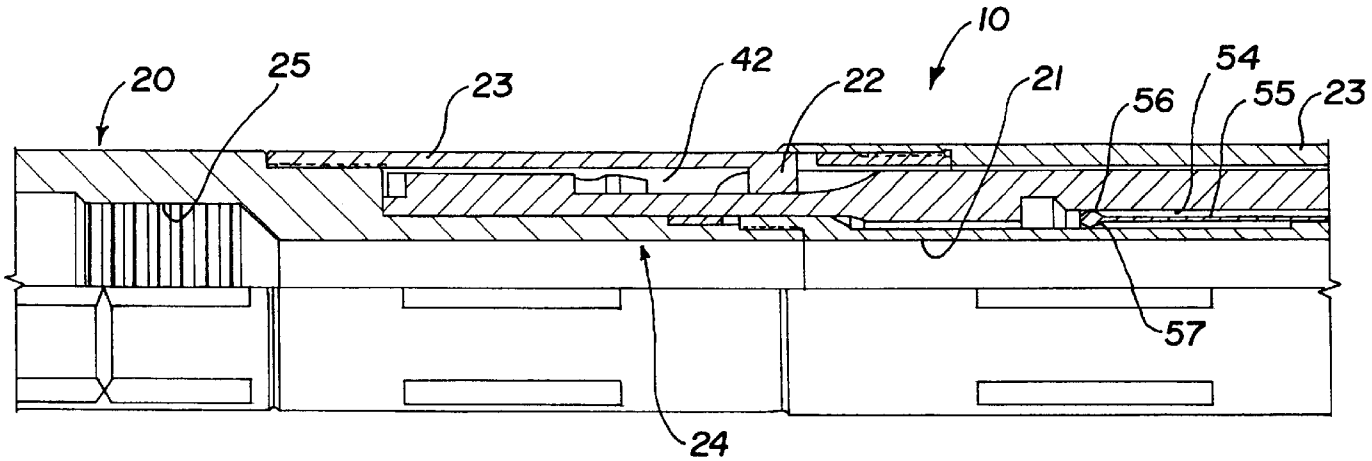
Figure 3B:
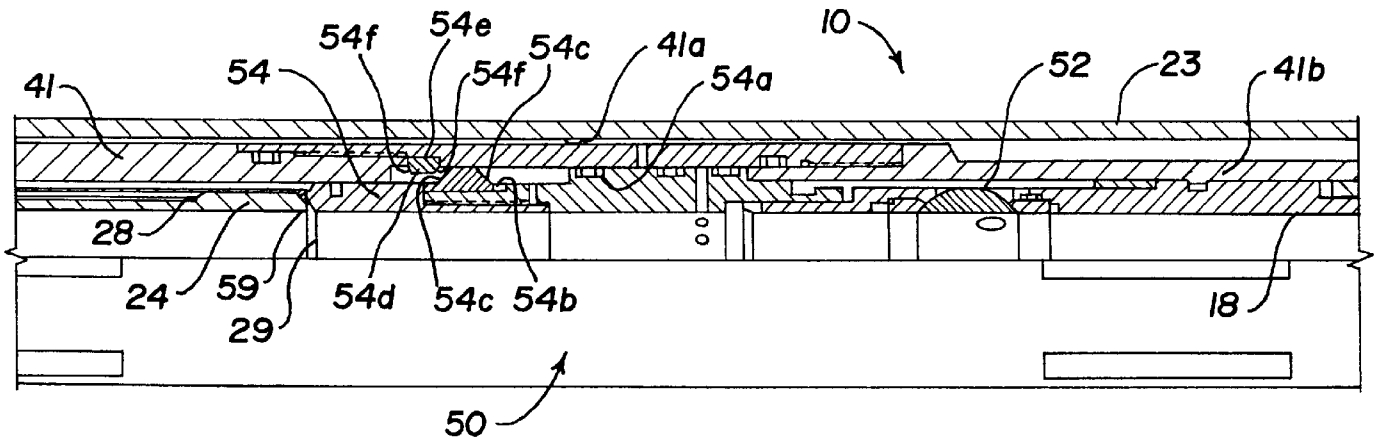
Figure 3C:
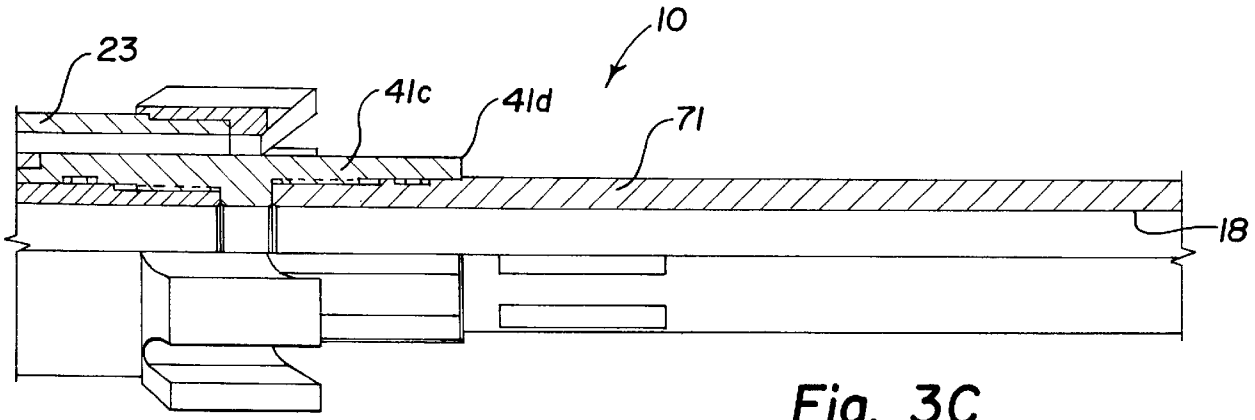
Figure 3D:
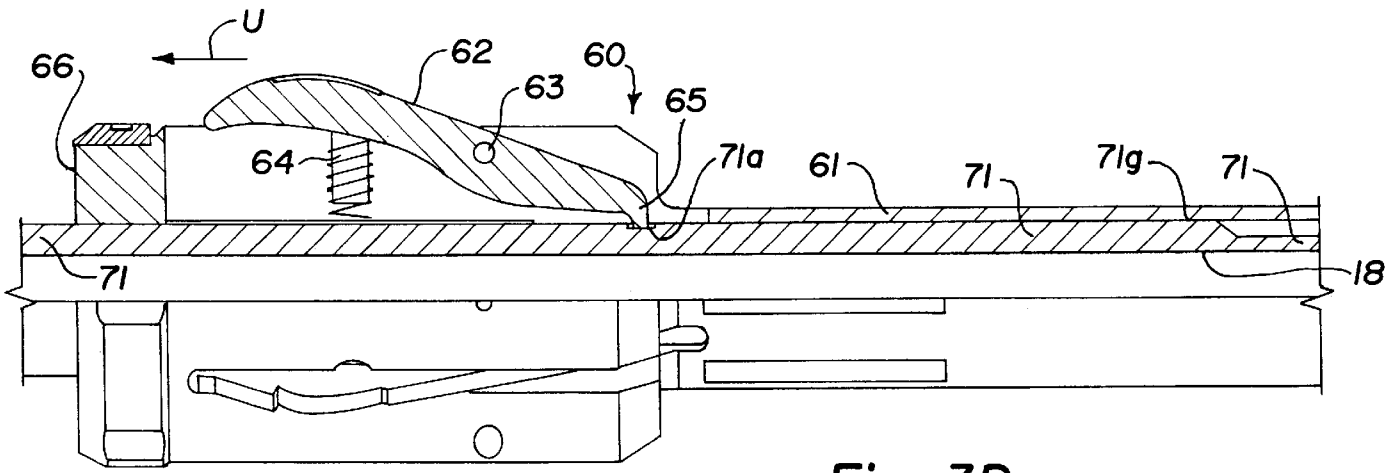

In FIG. 3D liner sensor subassembly 60 is illustrated in detail. As previously disclosed the liner sensor subassembly 60 acts as a lock to prevent setting of the bridge plug assembly 10 unless it is located inside a liner. Tubular lock body 61 of linear sensor subassembly 60 axially slides along the outer diameter of mandrel 71. Body 61 is in turn connected to the ratchet mandrel 91 of the slip and seal setting subassembly 90. Fingers 62 are mounted on pivots 63 in axially extending grooves formed in body 61. Compression springs 64 urge the fingers 62 to rotate in a clockwise direction with the lug end 65 contacting an annular locking groove 71*a* formed in the exterior of mandrel 71. In the run-in position (See FIG. 3D), lug ends 65 engage groove 71*a* and lock the mandrel 71 and body 61 against relative axial movement. When the fingers 62 encounter a liner or appropriate size casing, the fingers 62 are rotated to compress springs 64 lifting lug ends 65 out of groove 71*a*, freeing the body 61 and ratchet mandrel 91 to slide axially along mandrel 71 to set the bridge plug assembly 10. Releasing the fingers 62 allows the body 61 to slide along mandrel 71 in the direction of arrow "U" until shoulder 66 contacts shoulder 41*d* on adapter 41*c*. Adapter 41*c* is connected by threads to mandrel 71. According to the present invention the tool could be installed as a packer by disconnecting adapter 41*c* from mandrel 71. Tubing could be connected to the threads on mandrel 71 by using a thread adapter or the like.

Ratchet mandrel 91 extends through the seal subassembly 70 and slip subassembly 80 and terminates at its lower end with a set of circumferentially extending ratchet teeth 91*a*. Axially extending grooves 91*b* are formed in the ratchet mandrel 91 and extend along the axial length of the teeth 91*a*. A plurality of circumferentially spaced "Tee-bar" ratchet pawls 91*c* are held in grooves 91*b* by circumferential tension springs 91*d*. When in the run position shown in FIGS. 3F–H, teeth (not shown) on pawls 91*c* are radially spaced from and do not engage the teeth 91*a* as they are held axially off the teeth 91*a* by enlarged diameter portion 71*b* of mandrel 71. When the liner latch or fingers 62 is released the ratchet mandrel 91 axially moves along mandrel 71 in the direction of arrow U. This axial movement positions the pawl 91*c* over reduced diameter portion 71*c* (off the enlarged portion 71*b*) allowing the teeth on pawl 91*c* to engage the teeth 91*a*. As will be explained the slip and seal setting subassembly 90 is used to force the pawl 91*c* to move along the teeth 91*a* in the direction of arrow U to axially compress and set the seal and slip subassemblies.

Figure 3E:
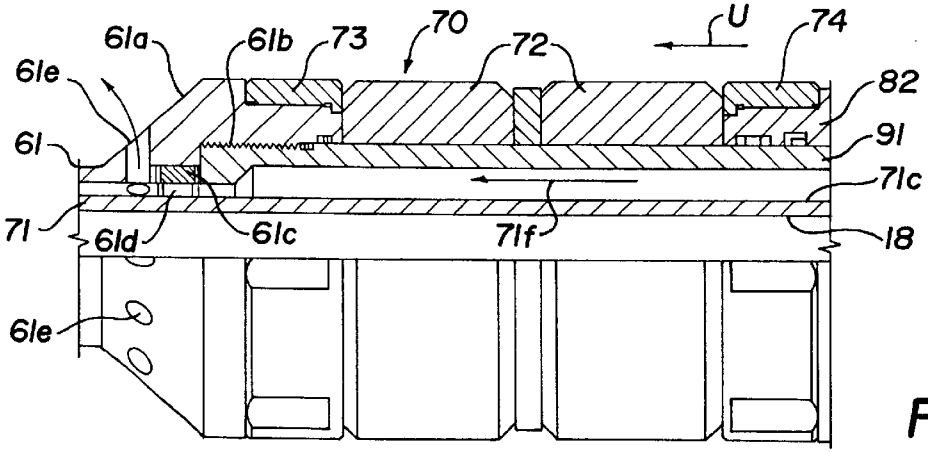

FIGS. 3E–3H illustrate one embodiment of the seal 70, slip 80 and slip and seal setting 90 subassemblies. As best illustrated in FIG. 3E the lower end of leek body 61 terminates with an enlarge portion 61*a*. Portion 61*a* is internally threaded at 61*b* to receive and connect to external threads on the upper end of ratchet mandrel 91. A suitable bypass seal assembly 61*c* is mounted in an internal groove in portion 61*a*. This seal 61*c* cooperates with a seat 71*g* (enlarged diameter portion on mandrel 71) and acts as a valve to selectively open and close an internal passageway for well fluids to bypass the seal and slip subassemblies. In the unset position (FIG. 3E) the bypass passageway is open, in that, the seal 61*c* is axially located over reduced diameter portion 71*c* of mandrel 71 creating an annular bypass passageway 61*d* between the reduced diameter portion 71*c* of mandrel 71 and the interior of enlarged portion 61*a*. When in the FIG. 3E run position, a plurality of radially extending ports 61*e* in enlarged potion 61*a* communicate with passageway 61*d*. As the tool is lowered into the well, well fluids bypass the seal and slip subassemblies 70 and 80 through the interior of ratchet mandrel 91 (see arrow 71*f*), past seal 61*c* through passageway 61*d* and out ports 61*e*. When body 61 is moved axially in the direction of arrow "U" to the set position, seal 61*c* will engage the seat 71*g* closing passageway 61*d*.

Seal subassembly 70 comprises suitable radially expandable deformable annular seal elements 72 positioned around ratchet mandrel 91 axially between upper and lower shoes 73 and 74, respectively. In the present embodiment seal elements 72 comprise elastomeric portions. As is conventional in downhole axial seal assemblies of this type, axial compression during setting the seal elements 72 radially deforms (expands) the seal elements 72 to seal against the interior of the tubular member in which the plug is set. The setting operation forces the lower shoe 74 in the direction of arrow "U" toward the upper shoe 73 compressing the seal elements 72. To unset or retrieve the plug, lower shoe 74 is released to move away from upper shoe 73 relaxing the seal elements 72 from engagement with the tubular member.

Figure 3F:
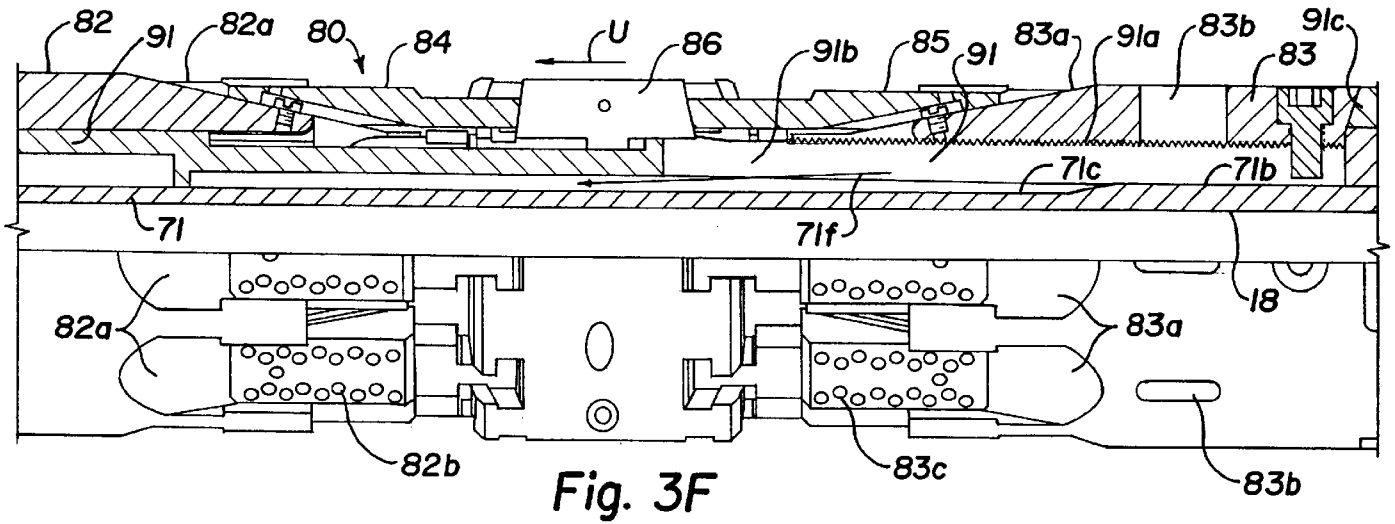

As illustrated in FIG. 3F slip subassembly 80 comprises upper and lower slip bodies 82 and 83, respectively, mounted axially slide on the ratchet mandrel 91. Each slip body 82 and 83 has a plurality of ramp surfaces 82*a* and 83*a* for cooperating with ramp surfaces on upper and lower slips 84 and 85, respectively. Lower slip body 83 has a plurality of axially extending slot shaped ports 83*b* providing fluid communication between the exterior of slip subassembly 80 and flow path 71*f*. A split ring collar 86 holds the individual slips 84 and 85 in place. The tool setting process causes the slip bodies 82 and 83 to be moved toward each other causing the ramp surfaces 82*a* and 83*a* to engage the slips 84 and 85 and force them radially outward to engage the wall of the surrounding tubular member. As previously mentioned, during setting the teeth on pawl 91*c* engage the teeth 91*a* on ratchet mandrel 91 (pawl 91*c* is positioned over reduced portion 71*c*). The teeth on the pawl 91*c* and ratchet mandrel 91 are inclined to slip in the set direction during setting. In the illustrated embodiment buttons (carbide teeth) 82*b* and 82*c* are formed on the exterior of the slips 84 and 85 to assist in gripping the interior wall of the tubular member. During unsetting or retrieving, the teeth on pawl 91*c* are separated from teeth 91*a* allowing the slip bodies 82 and 83 to move apart freeing the slips 84 and 85 to radially retract from engagement with the surrounding tubular member. It should be noted that the slips 84 and 85 that resist movement are located below the seal elements 72. This configuration protects the slips 84 and 85 from debris and makes the slips 84 and 85 easier to release and retrieve.

Figure 3G:
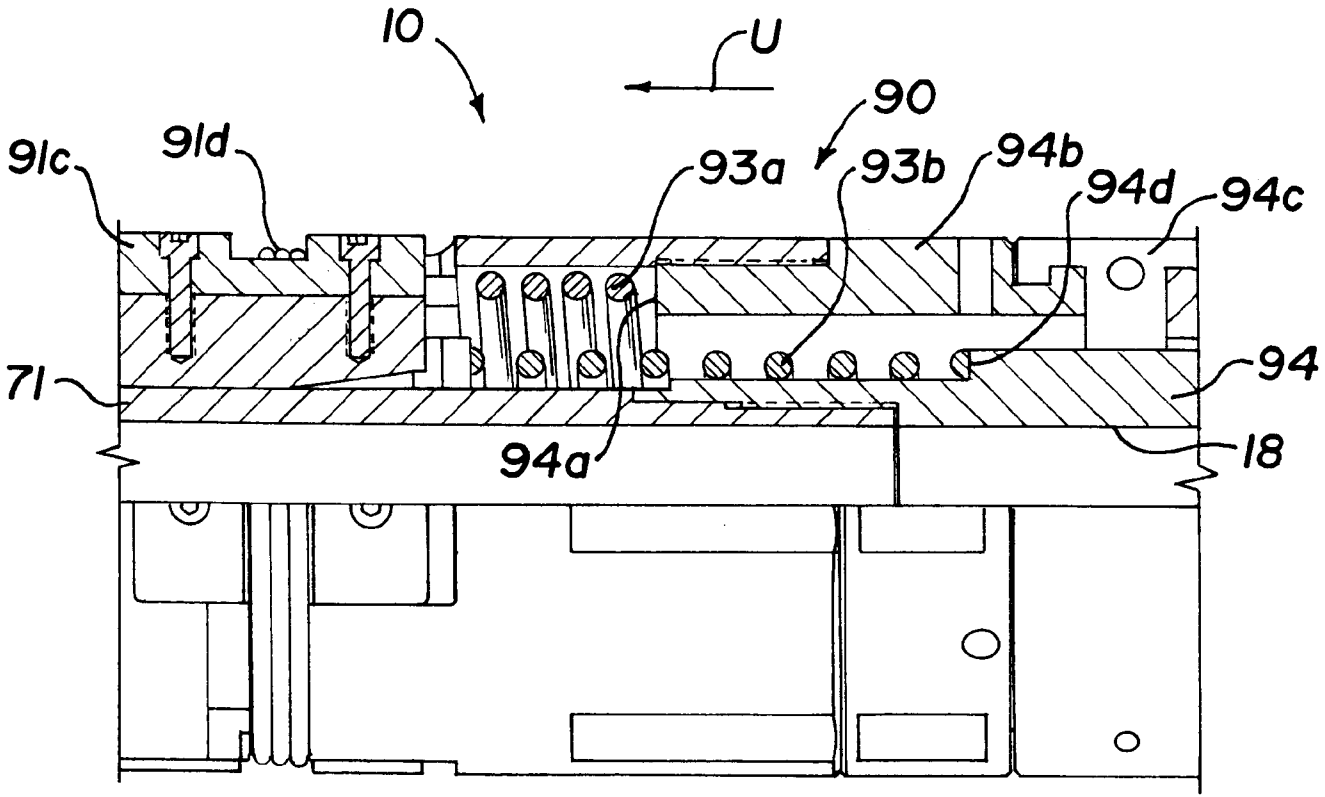
Figure 3H:
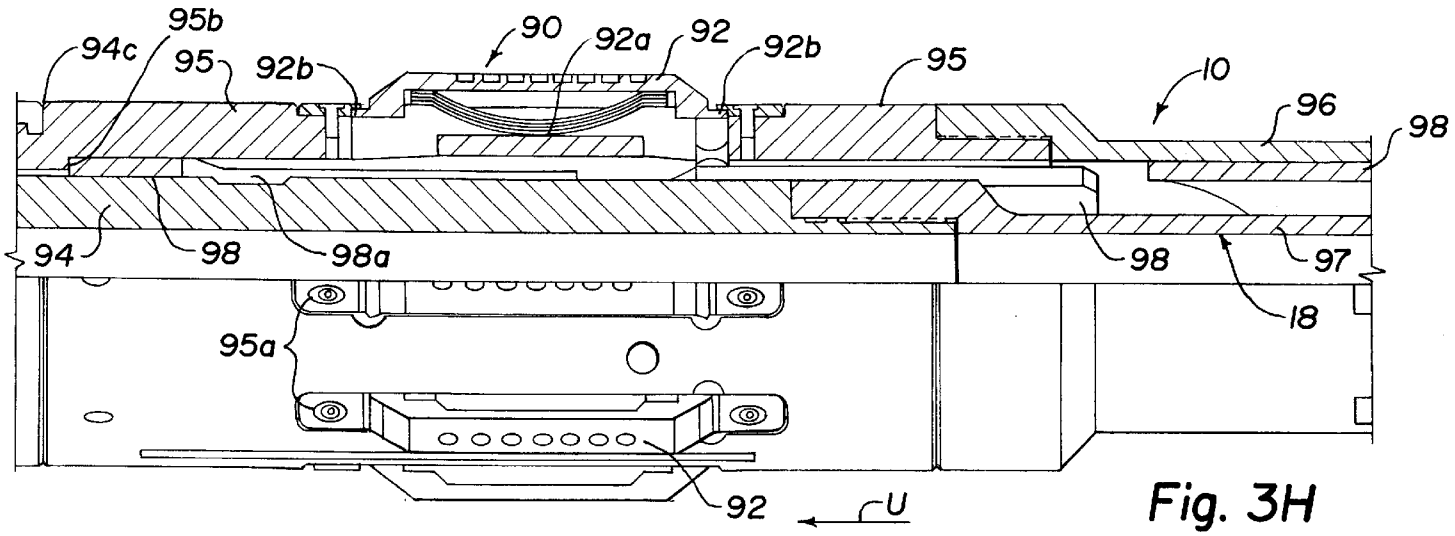
Figure 6:
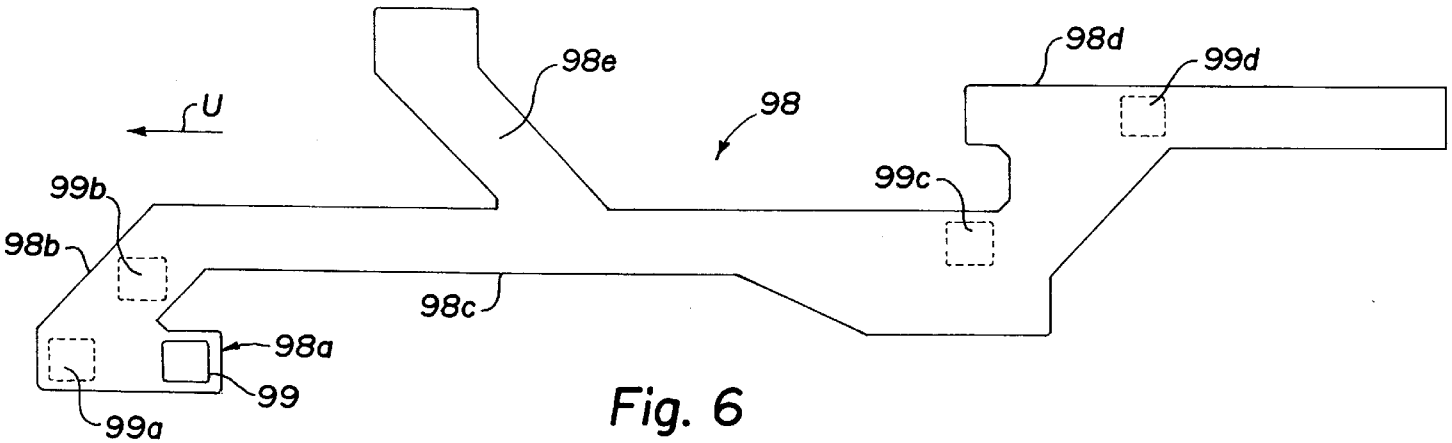
FIG. 6 is a diagram of the seal actuation j slot pattern in the bridge plug assembly in accordance with the present invention.
Figure 31:
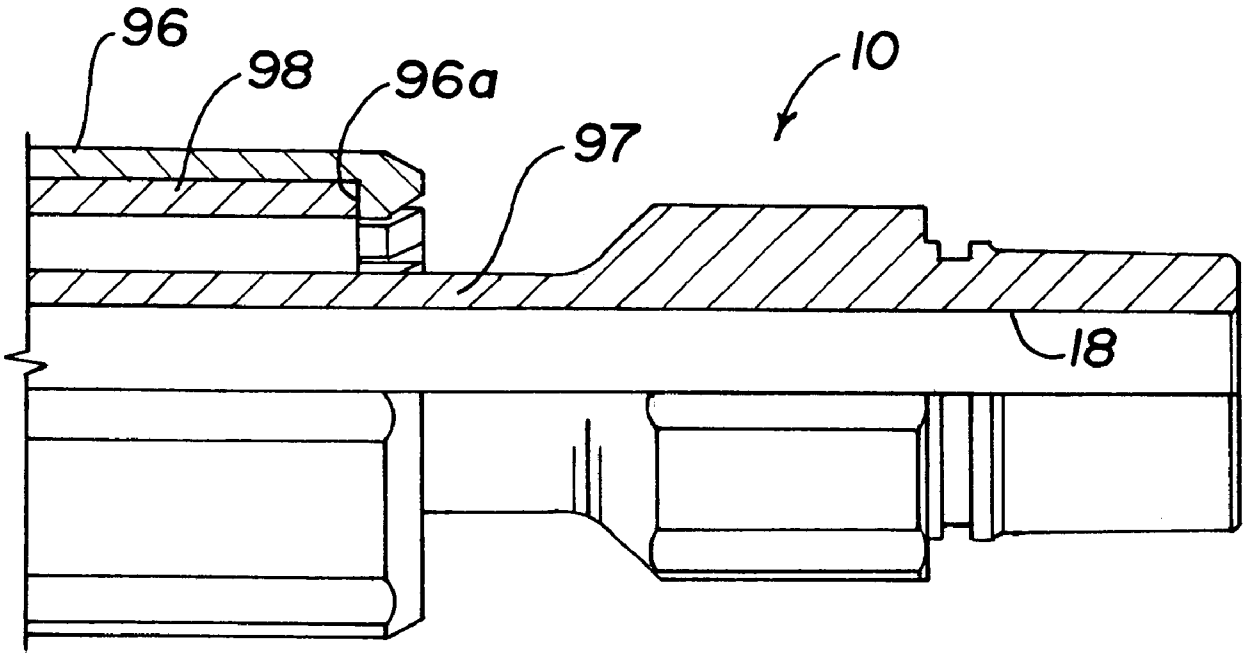

The details of the slip and seal setting subassembly 90 is illustrated in FIGS. 3G–3H and 6. Spring 93*a* contacts upward facing annular shoulder 94*a* on collar adapter 94*b*. Spring 93*a* is axially compressed between push block 93*c* and shoulder 94*a*. During setting spring 93*a* applies an axial force through push block 93*c* against the pawls 91*c* to bias the teeth on pawls 91*c* into engagement with teeth 91*a*.

Spring 93*b* is compressed between the ratchet mandrel 91 and an upward facing annular shoulder 94*d* on lower mandrel 94. Spring 93*a* urges the ratchet mandrel 91 upward (direction of arrow "U") with respect to the lower mandrel 94. Lower mandrel 94 is positioned between and connected by threads to mandrel 71 and lower mandrel extension 97. Lower mandrel extension 97 is coupled to tail pipe 100.

Drag block body 95 is connected to the collar adapter 94*b* by a collar 94*c*. Drag block body 95 has a plurality of axially extending slots 95*a* in which are mounted the drag blocks 92. Drag blocks 92 are biased outward by leaf springs 92*a*. Tabs 92*b* on drag blocks 92 limit radially outward travel to the position shown in FIG. 3H. Drag blocks 92 will engage the interior wall of the surrounding tubular member and cause frictional or drag forces resisting movement within the tubular member and it is these forces that are used to manipulate the bridge plug assembly 10 between the set and unset positions. The lower end of the drag block body 95 is connected by threads to drag block sleeve 96.

Lugs 99 on mandrel 94 engages to a pair of "J-slots" in sleeve 98 to control the setting and releasing of the bridge plug assembly 10. In FIGS. 3H and 3I, sleeve 98 is shown captured in the annulus between the inside of drag block body 95 and outside of lower mandrel 94. Sleeve 98 is mounted to move with drag block body 95 and is movable with respect to lower mandrel 94. Sleeve 98 is held in axial position between shoulder 96*a* on drag block sleeve 96 and shoulder 95*b* on drag block body 95. According to the present invention the sleeve 98 is simple to manufacture in that the slot pattern is cut in a sleeve rather than machined as a blind slot in a mandrel. It is envisioned that the slot pattern could be cut in one or more pieces of flat plate and later rolled into pieces when assembled form a sleeve. Changing the "J-slot" pattern to accommodate running the tool of the present invention in combination with different tools is a simple matter of removing and replacing the sleeve 98. Drag block sleeve 96 is unthreaded from the drag block body 95 to allow access to and removal of sleeve 98.

In FIG. 6 a slot pattern is illustrated flat with the lug 99 shown in various positions therein. Slot 98*a* has a first axially extending leg, which for descriptive purposes is designated as 98*a*. Lug position 99*a* is the pick up position. As the bridge plug assembly 10 is manipulated into the well a right hand torque is applied on lug 99 to maintain it in leg 98*a*. The axial length of leg 98*a* limits relative axial movement between the drag block body 95 and mandrel 94.

When in the proper well location for installation, the string is lifted up moving to lug position 99*a*. Left hand torque is applied while transferring weight down to the drag blocks 92 to move the lug 99 through the lug position 99*b* in inclined transition leg 98*b* and into the axially elongated transition leg 98*c*. As the lug 99 moves down to lug position 99*c*, mandrel 71 moves through the ratchet mandrel 91 until the pawl 91*c* reaches the reduced diameter portion 71*c* allowing the teeth on pawl 91*c* to engage with the teeth 91*a*. Further downward pressure on the string moves the lug 99 to lug position 99*d* into the setting leg 98*d*. Setting is accomplished by first applying and then relaxing downward force causing the pawl 91*c* to move up the teeth 91*a* on ratchet mandrel 91. As previously described, when the pawl 91*c* moves up on the ratchet mandrel 91, the seal subassembly 70 and slip subassembly 80 are set. As previously discussed, the bypass passageway 61*d* closes as the bridge plug assembly 10 is set. The retrieving tool 20 can be released and removed from the bridge plug assembly 10.

To release a previously set bridge plug assembly 10, the retrieving tool 20 engages the tool, then apply right hand torque and lift up. The lug 99 will move back into the transition leg 98*c* and the mandrel 71 will move up until the pawl 91*c* is engaged by the enlarged diameter portion 71*b* of the mandrel 71. This frees the pawl 91*c* from the teeth 91*a* and allows the seal and slip subassemblies 70 and 80 to relax and return to the unset position shown in FIG. 3. Also moving the mandrel 71 will open the bypass passageway 61*d*.

Leg 98*e* of the slot 98*a* is present to allow left hand torque to be applied for aiding in the removal of the bridge plug assembly 10 with downward force while running in conjunction with a packer. It is to be understood that a set of sleeves 98 with different "J-slot" patterns could be provided with each tool. Each sleeve could have a pattern accommodating a particular combination of tools. The present invention can conceivably be used as a storm valve, closing off the well bore and retaining the work string below the bridge plug. The retrieving neck and overshot can be removed, then replaced with a standard top adapter allowing the bridge plug to be converted to a packer.

The operation and construction of the present invention will be apparent from the foregoing description. While the embodiment shown and described has been characterized as being preferred, it will be readily apparent that various changes and modifications could be made therein without departing from the scope of the invention as defined in the following claims.

What is claimed is:

1. A tool assembly for use in a well bore, comprising:

a seal element on the exterior of the tool assembly for sealing the well bore;

a bypass passageway valve located in a bypass passageway, wherein the bypass passageway is open to the exterior of the tool assembly on opposed sides of the seal element for allowing fluid to bypass the seal element when the tool assembly is run into the well bore; and a tool passageway valve located in a tool passageway, wherein the tool passageway is of a size to accommodate the movement of well tools through the tool assembly;

wherein the bypass passageway and the tool passageway are isolated from each other, and the bypass passageway valve and tool passageway valve are operable by moving a tubing string relative to the tool assembly to selectively open and close the valves to selectively open and close either or both the bypass passageway or the tool passageway.

2. The tool assembly of claim 1 further comprising a lug receiving slot on the tool assembly for limiting the relative movement between the tubing string and the tool assembly.

3. The tool assembly of claim 1 wherein at least one of the valves is a ball valve.

4. The tool assembly of claim 1 wherein at least one of the valves is a sliding seal.

5. The tool assembly of claim 1 wherein the seal element comprises a compressible seal member.

6. The tool assembly of claim 1 further comprising radially expandable slips for engaging the well bore to hold the tool assembly in place in the well bore.

7. The tool assembly of claim 6 wherein the slips comprise a pair of longitudinally spaced slip assemblies, and the seal element is not positioned on the tool assembly between the slip assemblies.

8. The tool assembly of claim 1 wherein the seal element is radially expandable, and the tool assembly further comprises means on the tool assembly for preventing the seal element from radially expanding unless the tool assembly is positioned within a tubing in the well bore.

9. The tool assembly of claim 1 wherein the seal element is radially expandable, and the tool assembly further comprises a pipe sensor on the tool assembly locking the seal element against radial expansion unless the tool assembly is positioned within a tubing in the well bore.

10. The tool assembly of claim 1 further comprising a sleeve movably mounted on the tool assembly and operably associated with the seal element, wherein movement of the sleeve causes movement of the seal element between radially expanded and unexpanded positions.

11. The tool assembly of claim 10 further comprising a cooperating lug and slot on the tool assembly for limiting the relative movement between the sleeve and tool assembly.

12. The tool assembly of claim 1 further comprising a sleeve movably mounted on the tool assembly and operably associated with the tool passageway valve, wherein movement of the sleeve moves the tool passageway valve between the open and closed positions.

13. A method of performing services on a well; comprising the steps of:

providing a bridge plug comprising:

a seal element on the bridge plug, wherein the seal element is movable between an unset position with the seal element unexpanded and a set position with the seal element radially expanded; and a valve located in a longitudinally extending passageway extending through the bridge plug, wherein the passageway is of a size to allow well tools and fluid to pass through the bridge plug, and the valve is movable between a closed position in which the passageway is closed and an open position in which the passageway is open to well tool passage and fluid flow;

connecting a tubing string to the bridge plug;

lowering the bridge plug with the seal element unset into a tubing in the well while allowing fluid flow through a bypass passageway;

setting the bridge plug, wherein the step of setting the bridge plug comprises the steps of:

radially expanding the seal element to engage and seal the tubing; and closing the bypass passageway to prevent fluid flow therethrough;

closing the valve; and disconnecting the tubing string leaving the bridge plug in place to block fluid flow through the tubing.

14. The method of claim 13 further comprising the step of reconnecting a tubing string to the bridge plug to open the valve to provide fluid flow and well tool access through the passageway while the bridge plug is set in the tubing.

15. The method of claim 13 further comprising the step of locking the bridge plug against setting until the bridge plug engages the tubing.

16. The method of claim 13 further comprising the step of radially expanding slips on the bridge plug to engage the tubing to hold the bridge plug in place.

17. The method of claim 16 wherein the step of expanding the slips comprises the step of expanding a pair of opposed longitudinally spaced slip assemblies, and the seal element is not positioned between the slip assemblies.

18. The method of claim 13 wherein the valve is a ball valve.

19. A method of performing a downhole procedure in a well bore, comprising the steps of:

providing a first tool having a longitudinal passageway of a size to accommodate the passage of well tools through the passageway;

providing a second tool having a longitudinal passageway of a size to accommodate the passage of well tools through the passageway, wherein the second tool comprises:

a selectively actuatable radially expandable seal element on the exterior of the second tool;

a bypass passageway for bypassing fluid around the seal element;

a bypass passageway valve located in the bypass passageway;

a passageway valve located in the longitudinal passageway; and valve actuator mechanisms operably associated with the bypass passageway valve and the passageway valve to selectively open and close the valves to open and close either or both the bypass passageway or the longitudinal passageway of the second tool;

running the first and second tools while connected together into the well bore to a downhole location;

moving the first tool relative to the second tool to radially expand the seal element to close an annulus defined between the second tool and the well bore;

moving the first tool with respect to the second tool to operate the valve actuator mechanisms to close the bypass passageway;

moving the first tool with respect to the second tool to operate the valve actuator mechanisms to close the longitudinal passageway of the second tool; and disengaging the first tool from the second tool.

20. The method of claim 19 further comprising the steps of:

reengaging the first tool to the second tool;

moving the first tool with respect to the second tool to operate the valve actuator mechanisms to open the longitudinal passageway of the second tool; and moving a well tool through the first and second tools.

21. The method of claim 20 further comprising the steps of:

moving the first tool relative to the second tool to radially contract the seal element to open the annulus defined between the second tool and the well bore; and removing the reengaged first and a second tools from the downhole location.

22. A method of performing services in a well bore; comprising the steps of:

providing a bridge plug comprising:

a seal element on the bridge plug, wherein the seal element is movable between an unset position with the seal element unexpanded and a set position with the seal element radially expanded, and a bypass passageway is open to the exterior of the bridge plug on opposed sides of the seal element; and a valve located in a longitudinally extending passageway extending through the bridge plug, wherein the passageway is of a size to allow well tools and fluid to pass through the bridge plug, and the valve is movable between a closed position in which the passageway is closed and an open position in which the passageway is open to well tool passage and fluid flow;

connecting a tubing string to the bridge plug;

running the bridge plug into the well bore while allowing fluid flow through the bypass passageway;

setting the bridge plug, wherein the step of setting the bridge plug comprises the steps of:

radially expanding the seal element in the well bore; and closing the bypass passageway to prevent fluid flow therethrough;

closing the valve; and disconnecting the tubing string leaving the bridge plug in place to block fluid flow in the well bore.

23. The method of claim 22 further comprising the step of reconnecting a tubing string to the bridge plug to open the valve to provide fluid flow and well tool access through the passageway while the bridge plug is set in the well bore.

24. The method of claim 22 wherein the bypass passageway and the passageway are isolated from each other.

* * * * *